United States Patent [19]

Manning

[11] Patent Number: 4,538,786

[45] Date of Patent: Sep. 3, 1985

[54] CEILING FAN MOUNTING APPARATUS

[75] Inventor: Joseph H. Manning, North Fort Meyers, Fla.

[73] Assignee: Man-Mor Industries, Inc., Cape Coral, Fla.

[21] Appl. No.: 548,147

[22] Filed: Nov. 2, 1983

Related U.S. Application Data

[63] Continuation-in-part of Ser. No. 277,939, Jun. 26, 1981, abandoned.

[51] Int. Cl.[3] ..... F16M 13/00

[52] U.S. Cl. ..... 248/544; 248/27.1; 248/57; 248/656; 248/669

[58] Field of Search ..... 248/27.1, 56, 57, 656, 248/669, 675, DIG. 6, 343, 544; 211/105.2, 105.3, 105.4, 105.1, 123, 124; 403/43, 44, 45, 46, 47, 48

[56] References Cited

U.S. PATENT DOCUMENTS

| | | | |
|---|---|---|---|
| 1,226,211 | 5/1917 | Herskovitz | 248/343 |
| 1,368,239 | 2/1921 | Cohn | 248/343 |
| 1,733,840 | 10/1929 | Tefft | 248/343 |
| 1,796,036 | 3/1931 | Mangin | 362/404 Y |
| 2,056,169 | 10/1936 | Davison | 248/DIG. 6 |
| 2,140,861 | 12/1938 | Stekette | 248/57 X |
| 2,293,168 | 8/1942 | Pirone | 211/105.4 X |
| 2,420,363 | 5/1947 | Espenas | 403/43 |
| 2,671,821 | 3/1954 | Zientowski et al. | 248/340 |
| 2,711,876 | 6/1955 | Goebel | 248/343 |
| 2,713,983 | 7/1955 | Kay | 248/DIG. 6 |
| 2,732,162 | 1/1956 | McKinley | 248/DIG. 6 |
| 2,734,126 | 2/1956 | Kruger | 248/343 X |
| 2,770,436 | 11/1956 | Linhardt | 248/57 |
| 2,930,564 | 3/1960 | Maier | 248/DIG. 6 |
| 2,963,253 | 12/1960 | Maier et al. | 248/DIG. 6 |
| 2,967,928 | 1/1961 | Wolar | 248/343 X |
| 3,378,221 | 4/1968 | Wolar et al. | 248/343 |
| 3,425,655 | 2/1969 | Cogdill | 248/343 |
| 3,614,046 | 10/1971 | Lehman | 248/343 |
| 3,714,744 | 2/1973 | Koziarz | 52/28 |
| 4,114,326 | 9/1978 | Macuga | 248/DIG. 6 |
| 4,391,428 | 7/1983 | Grimes | 248/DIG. 6 |

FOREIGN PATENT DOCUMENTS

| | | | |
|---|---|---|---|
| 971512 | 7/1975 | Canada | 211/124 |
| 803769 | 4/1951 | Fed. Rep. of Germany | 248/345 |
| 116338 | 4/1946 | Sweden | 403/43 |

*Primary Examiner*—William H. Schultz
*Attorney, Agent, or Firm*—Kenneth E. Darnell

[57] ABSTRACT

Apparatus for mounting a fan or similar device to the ceiling of a building or mobile home, the invention also includes methods for installation of the apparatus and encompasses related embodiments of the apparatus. The several apparatus embodiments of the invention find utility within differing environments within which the apparatus is to be installed, certain of the embodiments being particularly useful for mounting a fan to the ceiling of a mobile home or the like and certain other embodiments being configured to facilitate mounting within the structural confines of standard building structures having one or more levels. In an embodiment useful for buildings having clearance above ceiling joists, the invention comprises an elongated bar configured to fit over upper surfaces of adjacent joists and to suspend an electrical outlet box beneath the bar with the fan being supported on a hook or double prong mounting bracket.

5 Claims, 16 Drawing Figures

34
36
38
40
41
42
46
48
50
52
70
72
74
76
78
80
82
84
88
90
92
94
96

FIG. 16
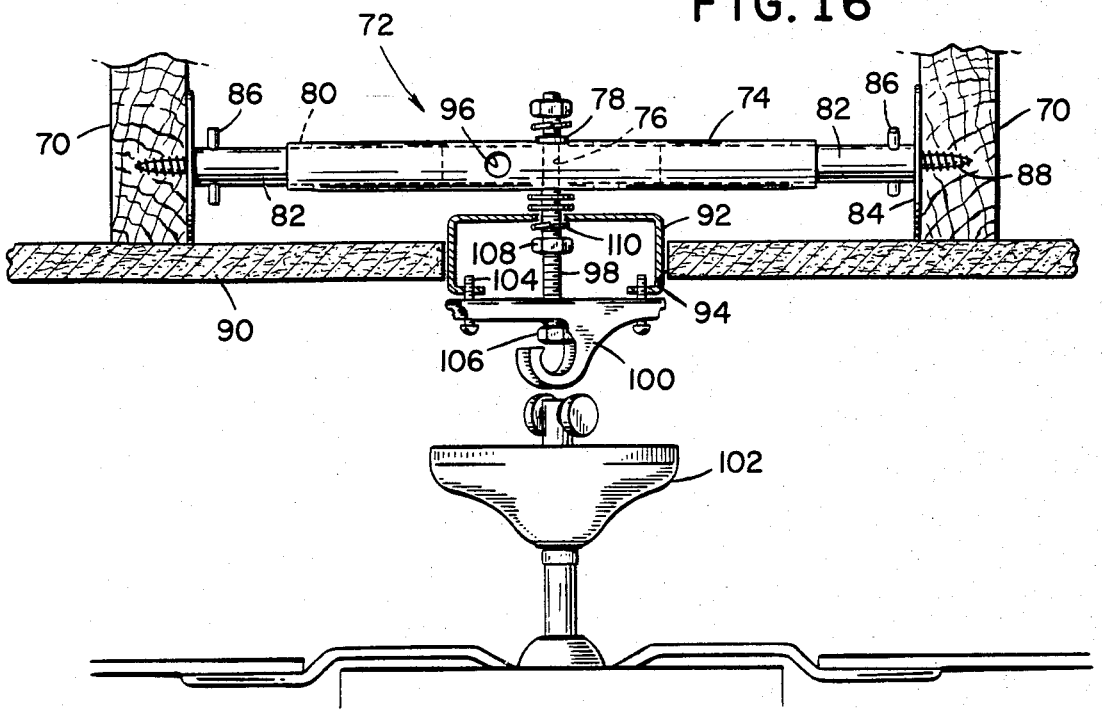
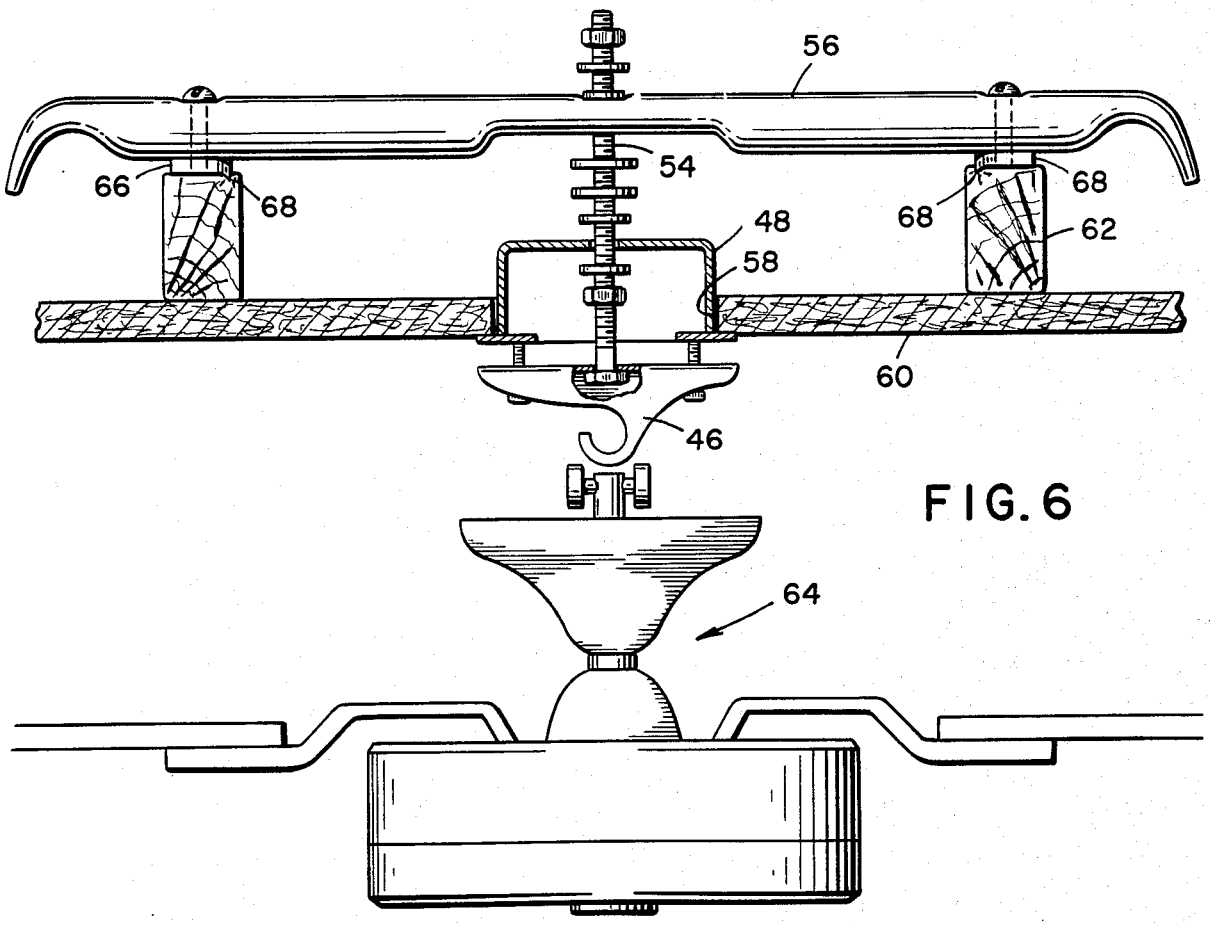
FIG. 6

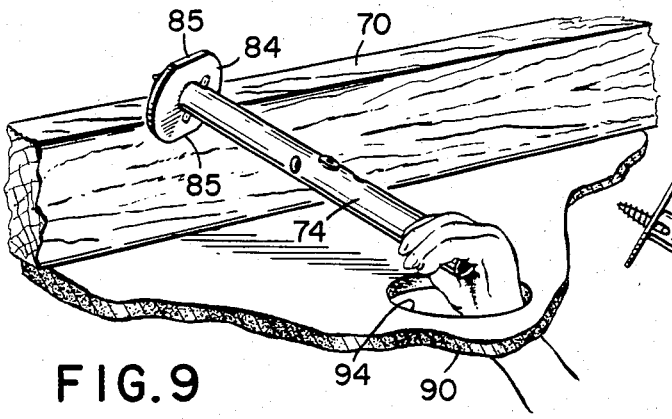
FIG. 9
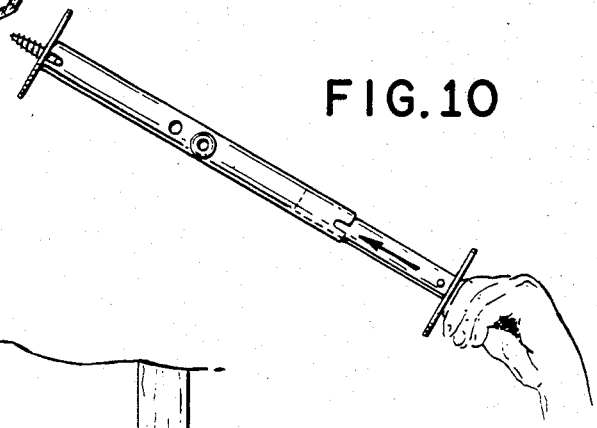
FIG. 10
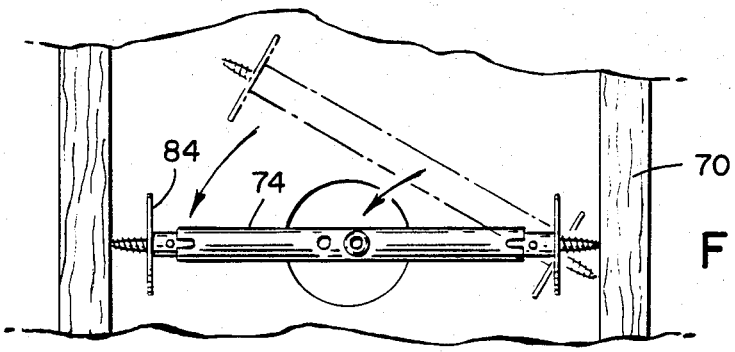
FIG. 11
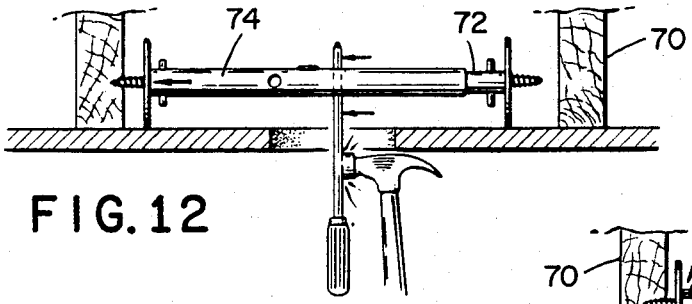
FIG. 12
FIG. 13
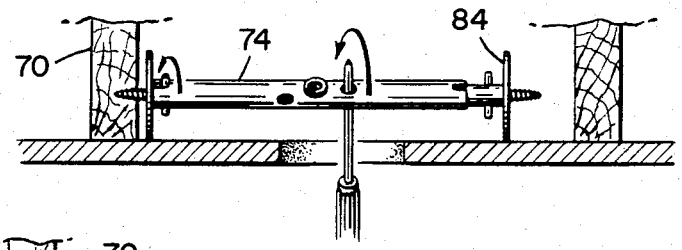
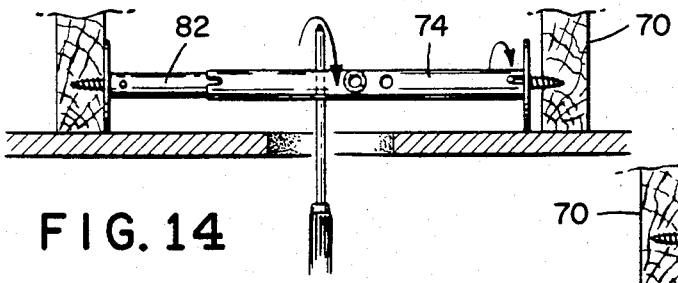
FIG. 14
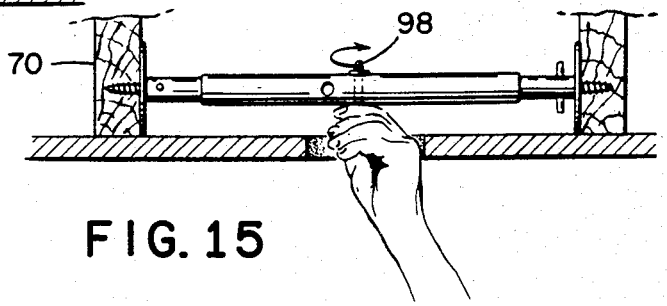
FIG. 15

CEILING FAN MOUNTING APPARATUS

CROSS-REFERENCE TO RELATED APPLICATION

This application is a continuation-in-part of U.S. patent application Ser. No. 277,939, filed June 26, 1981, for "Ceiling Fan Bracket for Mobile Home", now abandoned as of the filing date of this application.

BACKGROUND OF THE INVENTION

1. Field of the Invention

The invention related generally to mounting apparatus useful for supporting a fan or simlilar device from the ceiling of a building structure. In particular, the invention provides methods and apparatus for mounting a fan or similar device from the ceiling of various types of building structures, including the ceilings of different levels in multi-level buildings and from the ceilings of mobile homes and the like.

2. Description of the Prior Art

Ceiling fans and similar devices are often mounted within a living space in a building, mobile home or the like at a time subsequent to completion of the building. Such retrofit situtations usually find installation being performed by relatively unskilled persons with the result that the installation is not as secure as is desirable and the installation is unsafe. Further, it is often very difficult for such relatively unskilled installers to easily mount a ceiling fan with the mounting structure previously available to them, damage to the building structure and to the device being installed often occurring due to the difficulty of mounting previous support structure.

In many prior situations, a ceiling fan or similar device is mounted with a hook having an upper end portion formed as a woodscrew for insertion into a ceiling rafter or joist. However, such a prior arrangement does not usually provide a flush mounting to the ceiling and is therefore not as attractive as is desired. Further, with fans which are reversible, such installations are dangerous in that the motion of the fan can actually unscrew the threaded hook, thereby causing damage to the fan and potential serious injury to occupants of a living space in which the fan is being used.

In mobile homes, a light weight ceiling construction is typically encountered, conventional ceilings in mobile homes being comprised of a plurality of truss assemblies which are often on 16" centers. The ceiling itself in a mobile home is generally comprised of a light weight plywood, pressed board or similar materials, thereby making the installation of a relatively heavy ceiling fan or other device an impossibility with such ceilings due to the inability of such ceilings to support the necessary weight.

Retrofit mountings of ceiling fans and similar devices within conventional buildings also differ depending upon whether the fan is to be mounted in a ceiling which has space above the ceiling joists. For example, in a multi-level house, the retrofit (and initial) mounting of a ceiling fan differs in the ceiling just below a non-floored attic as opposed to the ceiling between two living levels. A ceiling existing between two living levels typically has joists with flooring disposed against the top surfaces thereof with no space being thus available to mount structure over the top surfaces of the joists for supporting a fan or other device in the lower living level.

The present invention intends solutions to the several problems described above by providing easily installed and safe apparatus capable of being installed in its several embodiments in both mobile homes and in the various ceiling/flooring situations existing in multi-level buildings.

SUMMARY OF THE INVENTION

The invention provides methods and apparatus for efficiently and safely mounting a fan or similar device to the ceiling of a dwelling or similar environmental space such as a conventional home, mobile home, or the like. In a first embodiment, the apparatus of the invention comprises an elongate bar-like member having at least one aperture formed medially of its length to receive threaded inserts for mounting a threaded rod or hook at right angles to the longitudinal axis of the member, an electrical outlet box and a fan being carried by the threaded rod or hook to mount same against a ceiling. The elongate member can preferably be tubular with its ends being downturned to allow convenient mounting of the elongate member over upper surfaces of ceiling joists so as to distribute the weight of the fan over a relatively large portion of the ceiling. In mobile homes, where ceiling jousts are of small size and light weight, it is absolutely necessary to spread the weight of the fan over portions of the building structure greater than a single joist. The elongate member can be provided with a series of apertures such that the threaded rod or hook can be placed along portions of the member to facilitate adjustment of the member over the joist and the threaded rod or hook in alignment with a hole cut in the ceiling in a retrofit situation.

A further embodiment of the invention is particularly useful in the mounting of a fan or the like in a situation where space does not exist above a ceiling joist, that is, the ceiling joists are used as a support surface for flooring of a living level above that living level within which the fan is to operate. In this embodiment of the invention, an elongate member having telescoping end sections is inserted between two joists with longitudinally disposed woodscrews extending one each from each telescoping section to allow connection to each joist. The telescoping end sections are provided with plates of a diameter sufficient to mount the structure at a desired distance above a hole cut in a ceiling to facilitate mounting of the apparatus in retrofit situation.

It is therefore an object of the present invention to provide apparatus for mounting a fan or similar device to the ceiling of a building or mobile home to accommodate varying situations existing in such structures.

It is also an object of the invention to provide apparatus for mounting a fan or similar device to a ceiling of a mobile home and wherein the apparatus comprises an elongate tubular member capable of spanning upper surfaces of adjacent joists and to be supported thereover in a position to dispose a vertical rod or hook mounted to the member over an opening in the ceiling such that a fan can be hung from the vertically oriented rod or hook.

It is another object of the present invention to provide a method and apparatus for mounting a ceiling fan or similar device to a ceiling of a building wherein ceiling joists also serve as supports for flooring of a living space surmounting that living space within which the fan is to operate, the invention including a bar from which a vertically arranged threaded rod or hook is mounted in alignment with a hole in a ceiling and wherein the member has telescoping end portions which are fastened to the sides of the ceiling joists by means of woodscrews extending lognitudinally from the end portions.

It is a further object of the present invention to provide methods and apparatus for mounting a ceiling fan or similar device to ceiling joists regardless of the arrangement of the ceiling joists relative to ceiling or flooring structure associated therewith.

Further objects and advantages of the invention will become more readily apparent in light of the following detailed description of the preferred embodiments.

BRIEF DESCRIPTION OF THE DRAWINGS

FIG. 6 is a side elevational view in partial section illustrating an apparatus according to a first embodiment of the invention and wherein a two-pronged mounting bracket is utilized to mount a ceiling fan to a ceiling;

FIGS. 9 through 15 are views illustrating the installation of the apparatus of FIG. 7 between adjacent ceiling joists; and FIG. 16 is a side elevational view illustrating the completed mounting of the apparatus of FIG. 7 with an electrical outlet box and the fan mounted therefrom.

DESCRIPTION OF THE PREFERRED EMBODIMENTS

Figure 1:
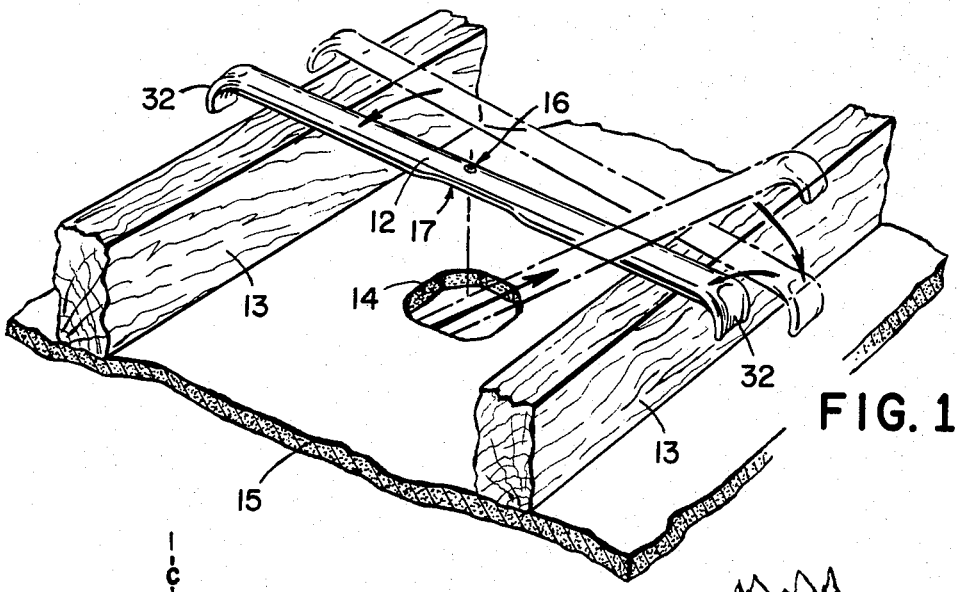
FIG. 1 is a perspective view of a portion of joists arranged in a ceiling and having space surmounting the joists such that apparatus according to the invention can be mounted thereover.
Figure 2:
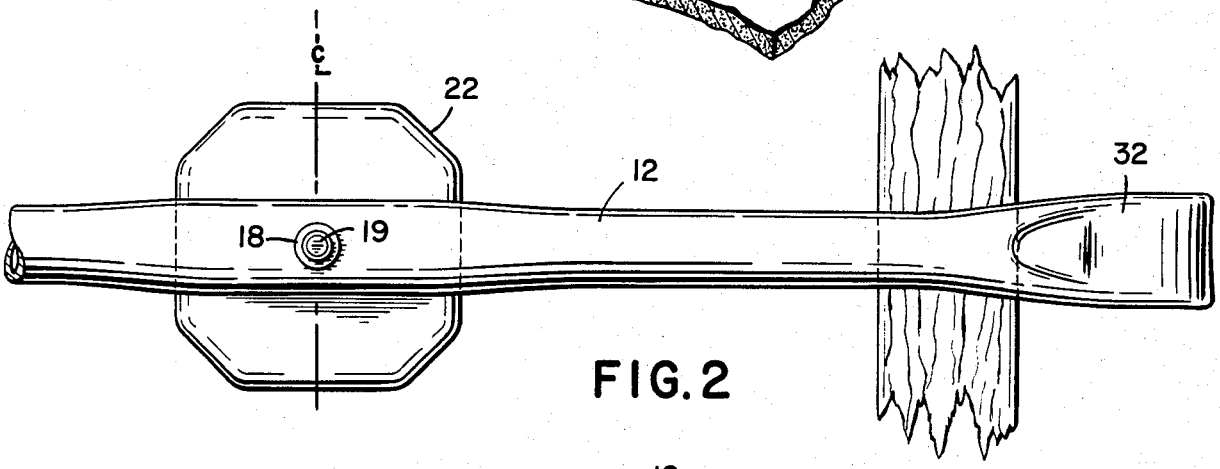
FIG. 2 is a detailed view partially cut away of apparatus according to the invention being mounted over a ceiling joist.
Figure 3:
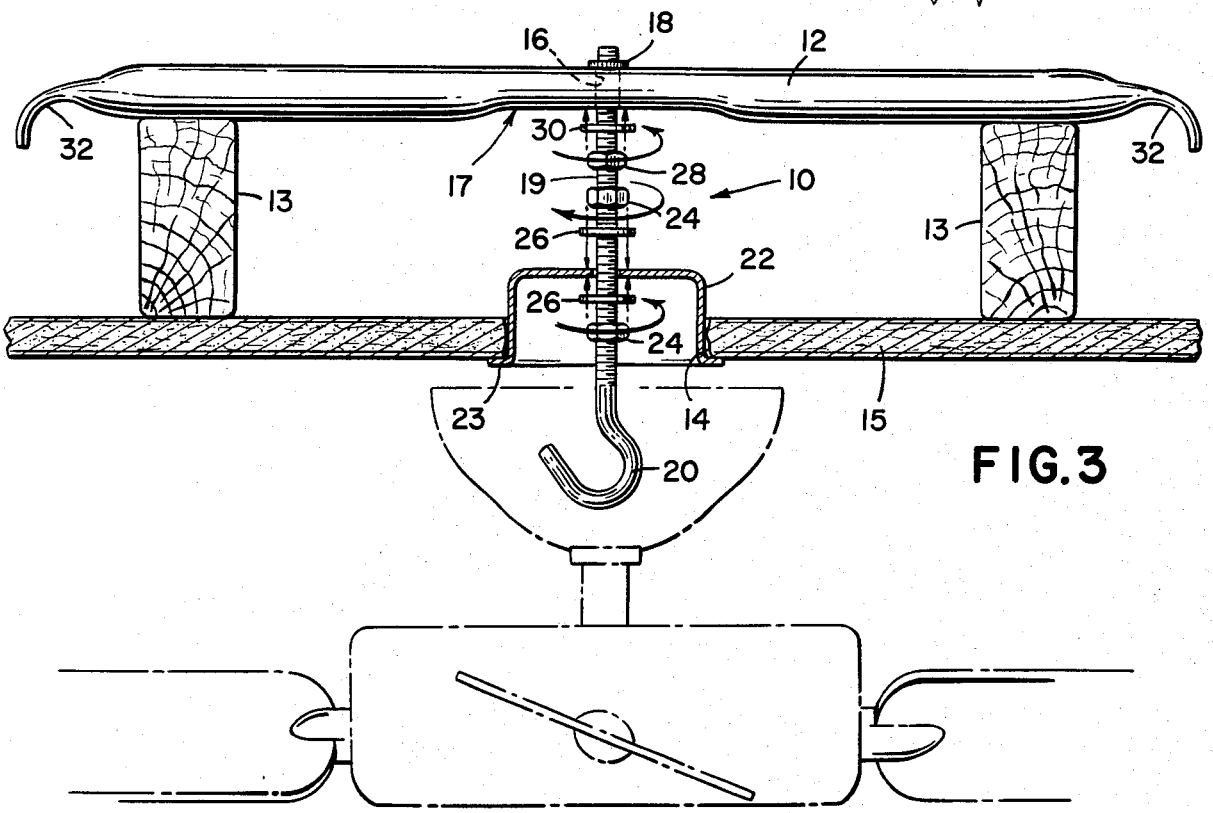
FIG. 3 is a side elevational view in partial section illustrating the mounting of a ceiling fan utilizing apparatus according to a first embodiment of the invention wherein an elongate bar is mounted over upper surfaces of adjacent ceiling joists.

Referring now to the drawings and particularly to FIGS. 1 through 3, a mounting apparatus shown generally at 10 in FIG. 3 according to a first embodiment of the invention is seen to comprise an elongate tubular member 12 which is disposed in surmounting relation to and in contact with upper surfaces of adjacent joists 13 forming a portion of a ceiling such as in a mobile home or conventional building. As is particularly shown in FIG. 1, a hole 14 is cut in ceiling 15 to allow the tubular member 12 to be inserted through said ceiling 15 and into position over the joist 13. During this installation operation, the tubular member 12 may be positioned without associated structure which will subsequently be described in order to facilitate positioning of said tubular member 12 over the joist 13. Alternatively, the tubular member 12 may be inserted through the hole 14 and positioned properly relative to said hole 14 with other portions of the mounting apparatus 10 being attached thereto as will be described. Referring to FIG. 1, it is seen that the tubular member 12 is extended upwardly through the hole 14 with one end of said member 12 being positioned over one of the joists 13 and the tubular member 12 then being fully extended through the hole 14 with the last end through the hole being brought backwardly into a contacting relation with the other joists 13 such that the tubular member 12 rests over both of said joists 13. The tubular member 12 is thus in position to mount a ceiling fan or other device as will be hereinafter described.

As best seen in FIGS. 2 and 3, the tubular member 12 is formed with a channel-like aperture 16 which is preferably disposed equidistantly from the ends of the member 12 or along the axial center line as is shown in FIG. 2. The tubular member 12 can be reduced in diameter at 17 to form a flattened indentation which accommodates upper surfaces of an outlet box 22 in those situations where the height of the joists 13 and/or the thickness of the ceiling 15 provide insufficient vertical distance to allow the box 22 to be flush with the ceiling 15. In FIG. 3, the height of the joists 13 is sufficient such that the area 17 is not utilized. The aperture 16 receives a threaded insert 18 which is fixedly mounted within the aperture 16. The threaded insert can take the form of a simple nut or a T-nut which is welded within the aperture 16. Regardless of the exact form taken by the threaded insert 18, the function of the insert 18 is to receive one end of a threaded rod 19, the rod 19 extending downwardly from the tubular member 12 to extend through the hole 14 formed in the ceiling 15. In the embodiment shown in FIG. 3, the threaded rod 19 has a hook 20 disposed at its lowermost end, the hook 20 mounting the ceiling fan. A rod having a single hook 20 at the lower end thereof is not suitable for fans which can be reversed in rotational direction. Such fans are to be mounted with the structure shown in FIG. 5 as will be described hereinafter.

The threaded rod 19 also mounts the electrical outlet box 22 between the tubular member 12 and the hook 20. The outlet box 22 is of a size which fits flushly within the hole 14 and, in fact, the hole 14 is cut to a size such that the outlet box 22 will fit flushly therewithin. The box 22 can be provided with a lip 23 which abuts the periphery of the hole 14 and aids in supporting the ceiling 15 due to the supporting action of the present apparatus. The outlet box 22 is held in place on the threaded rod 19 by means of cooperating nuts and washers 24 and 26 respectively, the nuts 24 being snugged down into contact with the outlet box 22 to allow placement of said box 22 at a desired location on the rod 19. Similarly, a nut 28 and washer 30 is snugged up against lower surfaces of the tubular member 12 in order to "lock" the threaded rod 19 in a desired position relative to the tubular member 12. Of course, the upper end of the threaded rod 19 is received within the threaded insert 18 at a desired insertion to cause the hook 20 to extend a desired distance from the ceiling 15.

The tubular member 12 can also be formed with downturned ends 32 which prevent slippage of the mounting apparatus 10 from the joist 13. The ends 32 can simply comprise crimping of the ends of the tubular member 12 with an arcuate bending of the crimped ends to provide the desired function.

Figures 4, 5, 7, 8:
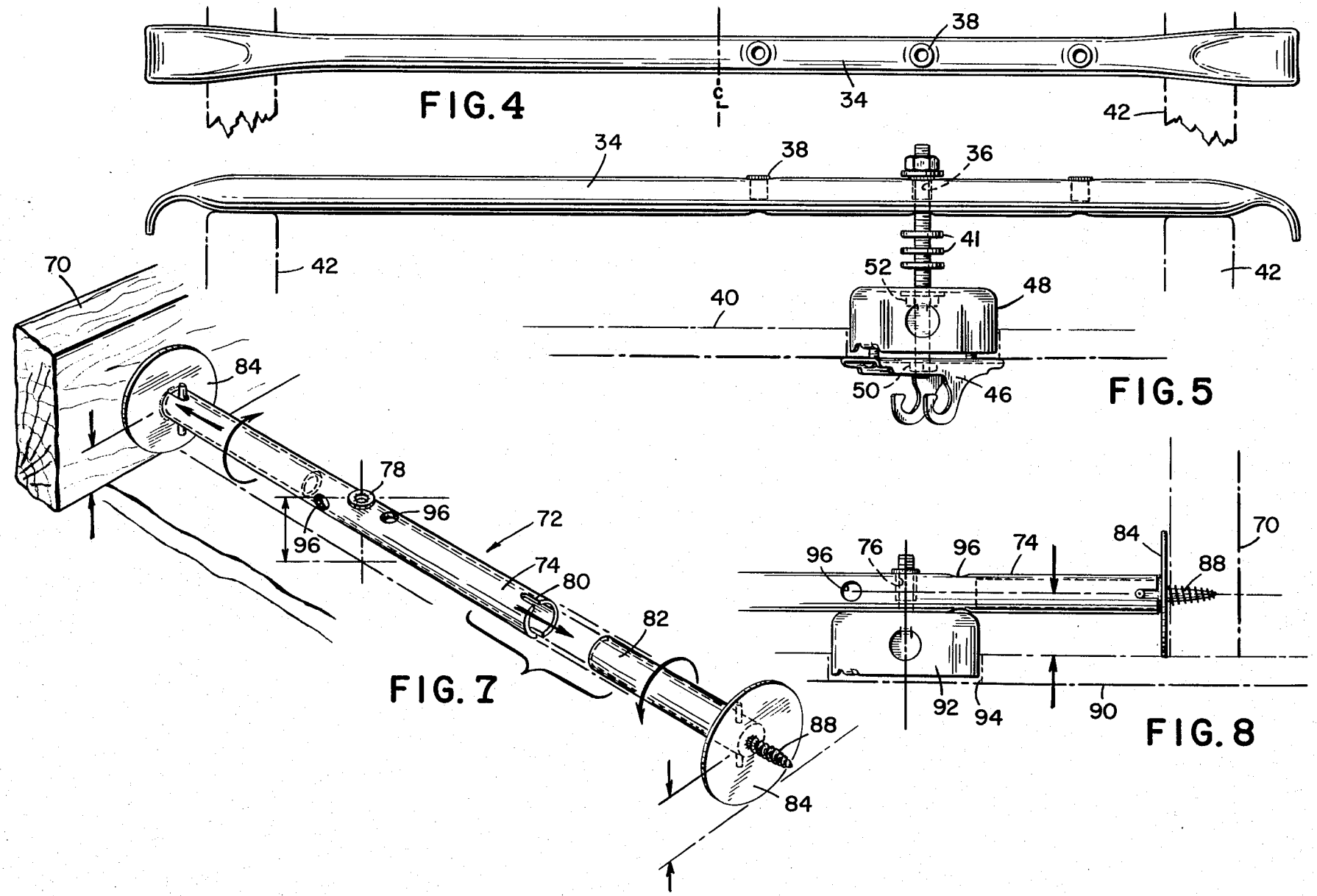
FIG. 4 is a plan view illustrating an alternate embodiment of the invention wherein a plurality of apertures are formed in an elongated bar mounted over adjacent ceiling joists, the apertures allowing adjustment of the apparatus to dispose at least one of the apertures over a hole located in a ceiling and through which hole connecytion to a fan or the like is accomplished.
FIG. 5 is a side elevational view illustrating the embodiment of FIG. 4 in an operative environment.
FIG. 7 is a perspective view illustrating a further embodiment of the invention which allows the apparatus of the invention to be mounted between ceiling joists.
FIG. 8 is a detailed view illustrating connection of a telescoping end portion of the apparatus of FIG. 7 to one of the adjacent joists to which the apparatus is fastened.

Referring now to FIGS. 4 and 5, a mounting apparatus configured according to another embodiment of the invention is seen to comprise a tubular member 34 which is substantially identical to the tubular member 12 of FIGS. 1 through 3. However, the tubular member 34 is formed with a series of three apertures 36 extending along one half portion thereof, the apertures 36 receiving threaded inserts 38 of the type which comprise the threaded insert 18. In use, the tubular member 34 need not be positioned precisely in order to align with a hole (not shown) in a ceiling, shown in phantom at 40, any one of the apertures 36 being positionable above said hole depending upon the location at which the hole is cut in the ceiling 40. In other words, a hole which is cut between joists 42 in FIGS. 4 and 5 can be effectively located anywhere between said joists 42 and the plurality of apertures 36 and threaded inserts 38 received therein allows alignment of one of the apertures 36 with said hole in order that threaded rod 44 can be properly aligned with said hole. The threaded rod 44 essentially corresponds to the threaded rod 19 of FIG. 3. However, the threaded rod 44 is not provided with a hook at the end thereof but simply comprises a rod which is threaded along its entire length in order to mount a double prong mounting bracket 46 at the lowermost end thereof. As can readily be seen, the bracket 46 is mounted to an outlet box 48 carried on the threaded rod 44, the bracket further being attached to the rod 44 by means of nuts 50 and 52 respectively. Two, three or more of the apertures 36 can be used and the innermost aperture 36 can be at the center of the tubular member 34 as is the aperture 16 in FIG. 3. Spacer washers 41 can be employed to snug the member 34 to the top of the outlet box 48 in those situations where the height of the joists 42 allow such modification. Otherwise, as in the situation shown in FIG. 5, the washers 41 are not necessary.

As seen in FIG. 6, an outlet box such as outlet box 48 and a double pronged mounting bracket 46 can be mounted by a threaded rod 54 and associated nuts and washers on a tubular member 56 having only a single aperture centrally disposed on the tubular member as is shown in FIG. 6. It is to be understood, however, that hole 58 cut in ceiling 60 must be generally positioned in order that the threaded rod 54 can be made to properly align with the hole 58. The fact that the tubular member 56 is generally longer than the spacing between joists 62 allows a certain degree of adjustment to be made by lateral movement of the tubular member 56 relative to the joists 62. As is also seen in FIG. 6, a fan 64 can be readily mounted to the bracket 46 in a conventional manner, the bracket 46 allowing mounting of a fan which has a reverse directional capability.

As is also seen in FIG. 6, barbed pads 66 can be attached at each end of the tubular member 56 at opposite ends of said member for engagement in the joist 62 to fix the mounting apparatus to the joist 62. The pad 66 can be relatively wide in order to allow the lateral adjustment of the tubular member 56 as discussed above. Barbs 68 can be struck from the pads such as by stamping in order to provide sharp points capable of cutting into the joist 62.

Referring now to FIGS. 7 and 8, a further embodiment of the invention can be seen to be of particular use in a situation where the mounting apparatus must be used between the ceiling and a surmounting floor in a conventional home. In such situations, upper surfaces of joists 70 have flooring (not shown) disposed directly over the joists 70 and in contact with upper surfaces thereof. In such a situation, the mounting apparatus must be installed between two joists 70 and fastened thereto. As particularly seen in FIG. 7, mounting apparatus 72 is formed of a central sleeve 74 having an aperture 76 located medially of its length and receiving a threaded inset 78 thereinto. Of course, a series of apertures 76 and threaded inserts 78 could be formed in the sleeve 74 as is described above relative to certain other embodiments of the invention. The sleeve 74 is further provided with oppositely aligned slots 80 in each end thereof, the slots 80 being disposed diametrically across the ends of the sleeve 74 from each other. The sleeve 74 is also of a diameter which allows cylindrical end members to be telescopingly received within each end of the sleeve 74, the end members 82 being of a diameter which allows sliding receipt of said end members within the interior of the sleeve 74. The end members are of a length which do not extend completely to the aperture 76 formed in the sleeve 74. When one of the cylindrical end members 82 is fully received into an end of the sleeve 74, an end plate 84 connected to the outer end of the end member abuts against the end of the sleeve 74. Further, diametrically disposed pins 86 are further received into the slots 80 when the end member 82 is fully received into the sleeve 74. The fitting of the pins 86 into the slots 80 cause the end members 82 to rotate with the sleeve 74 when said sleeve 74 is rotated about its longitudinal axis. On the face of each end plate 84 opposite that face which connects to the end member 82 is disposed a woodscrew 88 which is centrally mounted to said end plate 84 and which extends outwardly thereof in alignment with the aligned longitudinal axes of the sleeve 74 and the cylindrical end members 82. The woodscrews 88 at each end of the mounting apparatus 72 can be fastened into the joists 70 in a manner to be described hereinafter.

Referring to FIG. 8, it is to be seen that a radius of each end plate 84 is equal to that distance between the longitudinal axis of the sleeve 74 and the upper surface of ceiling 90, this distance allowing outlet box 92 to be properly located within hole 94 in the ceiling 90 to facilitate mounting of a fan thereto. The end plates 84 are also preferably chosen as being circular in conformation in order to allow the mounting apparatus to be rolled along the upper surface of the ceiling 90 to properly position the mounting apparatus 72 between the joists 70.

As seen in FIGS. 9 through 16, the sleeve 74 is further seen to have a hole 96 formed therein, the hole 96 not being shown in FIG. 7 for purposes of convenient illustration. The hole 96 is used to turn the sleeve 74 during installation of the mounting apparatus 72. In fact, a plurality of the holes 96 can be formed about the aperture 76 to facilitate turning of the sleeve 74 by means of a tool as will be described hereinafter.

Referring now to FIG. 9, the sleeve 74 and one of the end members 82 mounted on the sleeve 74 are inserted through the hole 94 in the ceiling 90, the hole 94 being cut to the size of an outlet box which is to be used with the mounting apparatus 72. The structure thus inserted through the hole 94 is preliminarily positioned and then the other end member 82 is inserted through the hole 94 and into the free end of the sleeve 74 as is shown in FIG. 10. This assembly is preferably accomplished between the joists 70 since the entire assembly can be difficult to extend through the hole 94 when flooring or other structure surmounts and contacts the upper surfaces of the joists 70. As seen in FIG. 11, the entire assembly of the sleeve 74 and the end members 82 are positioned relative to the hole 94 with the tips of the woodscrews 88 at each end of the mounting apparatus being disposed contiguously to the inner surfaces of the joists 70 and in a position preliminary to fastening the woodscrews 88 into the sides of said joists 70.

As seen in FIG. 12, a tool such as a screwdriver or other rod-like implement is extended into a hole 96, one end of which is disposed at 90° angles on each side of the aperture 76 and an implement such as a hammer used to drive one of the woodscrews 88 at least partially into the side of one of the joists 70. Once the woodscrew 88 is started in this fashion, the sleeve 74 is rotated by insertion of a screwdriver or similar tool into one of the holes 96 (or in alternating fashion into the holes 96) as is shown in FIG. 13 with the end member 82 being also rotated due to the mating of the pins 86 and slots 80, thereby to cause the woodscrew 88 to turn into the joists 70.

Once the woodscrew 88 is fully fastened into the joist 70, the opposite procedure is followed for the other end of the mounting apparatus 72, the sleeve 74 being moved in the other direction to fully receive the other end member 82 thereinto and to mate the slots 80 at the other end of the sleeve 74 with the pins 86 on the other end member 82. The implement received within the hole 96 is then hammered in the opposite sense of that shown in FIG. 12 so as to start the other woodscrew 88. Rotation of the sleeve 74 as described above but in the opposite sense fastens the woodscrew 88 on the other cylindrical end member 82 into the other joist 70, thereby to mount the mounting apparatus 72 between the two joists 70. The sleeve 74 can then be rotated as necessary and moved laterally relative to the end members 82 to position aperture 76 and the threaded insert 78 received therein such that a threaded rod 98 or threaded hook or the like can be received by the threaded insert 78 to allow mounting of the outlet box 92 and of a bracket 100 in a manner such as is described above such that a ceiling fan 102 can be mounted by the mounting apparatus 72.

Although the holes 96 are shown as being at 90° to each other, the holes 96 can be disposed in any angular relation about the aperture 76 and in numbers other than two in order to facilitate installation of the mounting apparatus 72.

As is shown in FIG. 9, the plates 84 can be provided with flats 85, preferably diametrically opposite each other, so that one of the flats 85 rests on the inner surface of the ceiling to stabilize the apparatus during final assembly. Only one of the flats 85 is necessary. Provision of the flats 85 on the plates 84 also facilitates manufacture and packaging of the apparatus.

The apparatus of FIG. 16 also discloses a feature which is of substantial importance. In particular, screws 104 also aid in mounting the bracket 100 to the outlet box 92, this structure being conventional. The threaded rod 98, however, also mounts to the bracket 100 by virtue of nut 106 and nut 108 and washer 110 in a manner similar to that shown in other embodiments. This additional mounting provides a "fail-safe" or redundant mounting feature which causes the present mounting apparatus to exhibit additional safety capability relative to prior art mounting structures.

Considering again the sleeve 74 of FIGS. 7 and 16 inter alia, it is to be understood that the length of the sleeve 74 can be varied to accommodate different distances between the joists 70. In a commercial embodiment of the apparatus of FIG. 7, two sleeves 74 of different lengths are included so that the apparatus can be installed between joists having different distances between centers, one of the two different sleeve lengths being of an adequate length to accommodate differing "standard" distances between joists in conventional building situations.

As can be appreciated from a review of the foregoing disclosure, modifications to the structure can be made without departing from the scope of the invention. In particular, the threaded inserts described as elements 18, 38 and 78 can take a number of forms as long as the function of receiving the threaded end of a vertical rod is provided. Further, the members 12, 34 and 56 can take other forms other than that of a tubular cylinder without departing from the scope of the invention. In essence, the scope of the invention can be seen to encompass a number of modifications and is thus to be interpreted in light of the recitations of the appended claims.

What is claimed is:

1. Apparatus for mounting a fan or similar device adjacent a ceiling having joists supporting the ceiling, comprising:

a vertical mounting rod adapted to be aligned with a hole in the ceiling and having the fan or similar device mountable to a lower end thereof; and, support means adapted to be carried by the adjacent joists for supporting the vertical mounting rod, the support means comprising a hollow sleeve having oppositely disposed slots at each end, an end member at each end of the sleeve and having an inner portion received within the sleeve and movable longitudinally therein and an end plate on the outer end thereof, a screw extending longitudinally from the outer face of the end plate to fasten to an opposing joist, each end member having a pair of diametrically arranged pins proximate to the end plate which are receivable in the slots in the sleeve on substantially full insertion of the inner portion of said end member to cause the sleeve and end member to be rotatable together, and, means carried by the sleeve for facilitating rotation of the sleeve.

2. The apparatus of claim 1 and further comprising:

an outlet box carried at a lower end of the vertical mounting rod; and, means carried by the support means for vertically adjusting the position of the outlet box relative to the support means.

3. The apparatus of claim 1 and further comprising means for horizontally adjusting the position of the mounting rod, the said means including the hollow sleeve and the inner portions of the end members which are slidably movable within the respective ends of the sleeve.

4. Apparatus for mounting a fan or similar device adjacent a ceiling having joists supporting the ceiling, comprising:

a vertical mounting rod adapted to be aligned with a hole in the ceiling;

an outlet box carried at a lower end of the vertical mounting rod;

support means adapted to be carried by adjacent joists for supporting the vertical mounting rod, the support means comprising a hollow sleeve having oppositely disposed slots at each end, an end member at each end of the sleeve and having an inner portion received within the sleeve and movable longitudinally therein and an end plate on the outer end thereof, a screw extending longitudinally from the outer face of the end plate to fasten to an opposing joist, each end member having a pair of diametrically arranged pins proximate to the end plate which are receivable in the slots in the sleeve on substantially full insertion of the inner portion of said end member to cause the sleeve and end member to be rotatable together, and means carried by the sleeve for facilitating rotation of the sleeve; and, means carried by the support means for vertically adjusting the position of the outlet box relative to the support means and to the hole in the ceiling.

5. The apparatus of claim 4 wherein the end plates are circular and the radius of each end plate is substantially equal to a distance between the longitudinal axis of the sleeve and an upper surface of the ceiling, the distance being chosen to locate the outlet box within the hole in the ceiling to provide at least a coarse adjustment of the position of said outlet box.

* * * * *